US009062664B2

(12) United States Patent
Lishanski et al.

(10) Patent No.: US 9,062,664 B2
(45) Date of Patent: Jun. 23, 2015

(54) LISHANSKI'S VIBRATORY CAVITATION PUMP

(71) Applicants: Grigori Lishanski, Mequon, WI (US); Oleg Lishanski, Buffalo Grove, IL (US)

(72) Inventors: Grigori Lishanski, Mequon, WI (US); Oleg Lishanski, Buffalo Grove, IL (US)

( * ) Notice: Subject to any disclaimer, the term of this patent is extended or adjusted under 35 U.S.C. 154(b) by 0 days.

(21) Appl. No.: 13/722,549

(22) Filed: Dec. 20, 2012

(65) Prior Publication Data

US 2013/0121848 A1 May 16, 2013

Related U.S. Application Data

(62) Division of application No. 13/075,819, filed on Mar. 30, 2011, now Pat. No. 8,353,689.

(51) Int. Cl.

| | |
|---|---|
| ***F04B 7/04*** | (2006.01) |
| ***F04B 15/02*** | (2006.01) |
| *F04B 9/04* | (2006.01) |
| *F04B 53/12* | (2006.01) |

(52) U.S. Cl.

CPC ... *F04B 7/04* (2013.01); *F04B 9/04* (2013.01); *F04B 53/122* (2013.01); *F04B 15/02* (2013.01)

(58) Field of Classification Search

CPC ..... F04B 9/04; F04B 53/122
USPC ..... 417/415, 491, 493, 534, 487, 552, 553, 417/430; 91/422; 222/231, 246, 409
See application file for complete search history.

(56) References Cited

U.S. PATENT DOCUMENTS

| | | | | | |
|---|---|---|---|---|---|
| 2,918,879 | A * | 12/1959 | Cervo | ..... | 417/269 |
| 2,985,359 | A * | 5/1961 | Hanje | ..... | 417/511 |
| RE32,144 | E * | 5/1986 | Keefer | ..... | 210/637 |
| 5,634,780 | A * | 6/1997 | Chen | ..... | 417/553 |
| 6,315,533 | B1 | 11/2001 | Lishanski et al. | | |
| 6,364,622 | B1 | 4/2002 | Lishanski et al. | | |
| 6,428,289 | B1 | 8/2002 | Lishanski et al. | | |
| 6,604,920 | B1 | 8/2003 | Lishanski et al. | | |
| 7,018,089 | B2 * | 3/2006 | Wenz et al. | ..... | 366/130 |
| 7,354,255 | B1 * | 4/2008 | Lishanski et al. | ..... | 417/491 |
| 7,544,048 | B2 | 6/2009 | Lishanski et al. | | |
| 7,731,105 | B2 | 6/2010 | Lishanski et al. | | |
| 8,353,689 | B2 * | 1/2013 | Lishanski et al. | ..... | 417/493 |
| 2009/0116979 | A1 | 5/2009 | Lishanski | | |

* cited by examiner

*Primary Examiner* — Christopher Bobish
(74) *Attorney, Agent, or Firm* — Boyle Fredrickson, S.C.

(57) ABSTRACT

A vibratory cavitation pump is provided that includes a working cylinder having an fluid inlet and a fluid outlet, a rod extending into the cylinder, a piston fixed to the rod, a plate fixed to the rod and spaced from the piston, an activator slidably mounted to the rod between the piston and the plate and an oscillating pumping mechanism operably connected to the rod to move the rod with respect to the working cylinder. The sliding activator creates cavitation in the fluid being pumped to increase the ease of pumping the fluid, such as high viscosity fluids. The pump can also include an external cylinder disposed around the working cylinder to impart rotational motion to the incoming fluid, thereby enhancing the cavitation created in the fluid by the pump, rendering the fluid easy to displace.

7 Claims, 3 Drawing Sheets

LISHANSKI'S VIBRATORY CAVITATION PUMP

CROSS-REFERENCE TO RELATED APPLICATIONS

This application claims priority from U.S. patent application Ser. No. 13/075,819, filed on Mar. 30, 2011, and allowed on Sep. 17, 2012, the entirety of which is expressly incorporated herein.

FIELD OF THE INVENTION

The present invention relates generally to pumps, and more specifically to pumps utilizing vibration to move the fluid through the pump.

BACKGROUND OF THE INVENTION

A variety of fields of industry and science it is necessary to move a fluid from one location to another. A wide range of pumping devices are available for accomplishing this task. In particular, one type of pump that is especially useful for this task are those pumps disclosed in U.S. Pat. Nos. 6,315,533; 6,364,622; 6,428,289; 6,604,920; 7,354,255B1; and 7,731,105B2, as well as in Published US Patent Application No. US2009/0116979, each of which is expressly incorporated by reference herein.

However, certain design features of these vibratory piston pumps do not allow effective pumping of liquids of higher viscosities, such as, for example, liquid soap, lubricating oils and similar high viscosity liquids. When liquids or fluids of this type are pumped utilizing the piston vibratory pump disclosed in the incorporated references, while the fluid can be pumped, the overall productivity or volume of the fluid pumped/minute decreases and consequent increase in energy consumption the pump drive mechanism occurs.

Therefore, it is desirable to develop a pump capable of utilizing the effective vibratory drive system as described in the cited references with a pump construction that enables fluids having high viscosities to be pumped by the device as effectively as lower viscosity fluids or liquids.

SUMMARY OF THE INVENTION

According to one aspect of the present disclosure, a pump including a vibrating mechanism is provided that is capable of effectively pumping a variety of fluids, including fluids having a high viscosity. In vibratory pump of the present disclosure, this result is achieved by change in the design of the internal working bodies of the pump which effectively causes the various liquids to temporarily decrease the viscosity of the fluid to enable the fluid to be pumped through the device. The vibratory mechanism in the pump includes a piston, an activator, and an apertured disk disposed within a working cylinder, which optionally is included within an external cylinder, a target valve and a drive mechanism connected to a rod extending into the working cylinder on which the piston, activator and disk are mounted. The piston and disk are secured to the rod, while the activator is slidable with regard to the rod, and is held on the rod based on its positioning between the piston and the disk and the sizes of the piston and disk, each of which have a diameter less than external diameter of the activator, but greater than diameter of an internal channel of the activator through which the rod extends.

In operation, as the drive mechanism oscillates or vibrates the rod within the working cylinder, and fluid is drawn upwardly into the working cylinder along an inlet due to the vacuum created within the working cylinder as a result of the movement of the rod, as described in the U.S. patents and applications cited previously. When the fluid reaches the working cylinder, the activator interacts with the fluid as the activator slides between the piston and the disk to create cavitation within the fluid. By creating air bubbles or pockets in the fluid, the cavitation reduces the viscosity of the fluid, enabling it to be efficiently discharged from the pump. In other words, the influence of cavitation on the liquid raises pressure of the liquid in the working cylinder, thereby reducing the kinematic viscosity of the liquid, enabling it to be pumped more effectively.

In certain embodiments or uses, the pump can be utilized to assist in facilitating chemical reactions due to the ability of the pump to break down the material being pumped to increase its chemical activation for use in various chemical reaction processes using the pumped materials as reactants. The energy of the mechanical impact of cavitation on various compounds in liquid solutions happens to be enough for breaking chemical bonds in molecules. Even at comparatively soft conditions, the stress level imparted to the material by the cavitation created in the pump is significantly higher than strengths of chemical bonds (~4.8-5.5×$10^{42}$ erg). Mechanical destruction of the materials due to the cavitation in the pump results in formation of free radicals capable of g chemical reactions. This mechanical destruction of the material result in significant change of physic-chemical properties of materials, formation of new functional groups, change of solubility and viscosity, formation of network systems.

A manageable process of cavitation within the pump to achieve these results on the material being pumped can be realized at certain values of amplitudes and frequency of vibration and, with a suitable geometry or cross-section of the chamber in which the material being pumped is subjected to the cavitation forces, or "reactor", which may have rectangular or cylinder shapes. In the case of a rectangular reactor, the cavitation interaction happens directly between the liquid material and parts of the device as they interact. Alternatively, in the case of a cylindrical reactor, the cavitation creates vortices and streams of liquid, and inside the streams spinning and oscillation of particles and other interactions occurs between the liquids and/or solid particles which may be present. Vibration and vortex interaction consequently reduces the friction of outer layers of the vortex that interact with walls of the chamber or other structure, and reduces liquid's viscosity, increasing the ease of pumping the fluid.

According to another aspect of the present invention, the working cylinder includes an external cylinder disposed around the working cylinder. The external cylinder is in fluid communication with the working cylinder via apertures in the working cylinder, and includes an integral annular ring disposed about the circumference of the external cylinder. The ring is attached to a pipe that is oriented at a tangent to the ring and is inserted into the reservoir of the fluid being pumped in order to draw the fluid into the ring. Upon entering the ring, the orientation of the ring causes the fluid to move circumferentially around the ring prior to flowing into the external cylinder, where the fluid continues to flow circumferentially around the working cylinder prior to entering the working cylinder. The motion imparted to the fluid by the ring enables the fluid to co-operate with the piston, the activator and the disk in creating the cavitation within the fluid, thereby raising the efficiency of the flow of the liquid into the vibratory cavitation pump. Further, the high frequency of oscillation of the rod with the piston, the activator and the disk allows a high flow rate stream of a liquid (e.g., more than 5 m/sec) to enter and be acted upon by the pump, which creates steady process cavitation within the pump. The influence of cavitation on the liquid raises pressure in the internal cavity of the working cylinder, reduces kinematic viscosity of the liquid and increases the destruction and chemical activation of the liquid.

Additional aspects, features and advantages of the present disclosure will be made apparent from the following detailed description taken together with the drawing figures.

BRIEF DESCRIPTION OF THE DRAWINGS

The drawings illustrate the best way of practicing the present disclosure.

In the drawings.

DETAILED DESCRIPTION OF THE INVENTION

Figure 1:
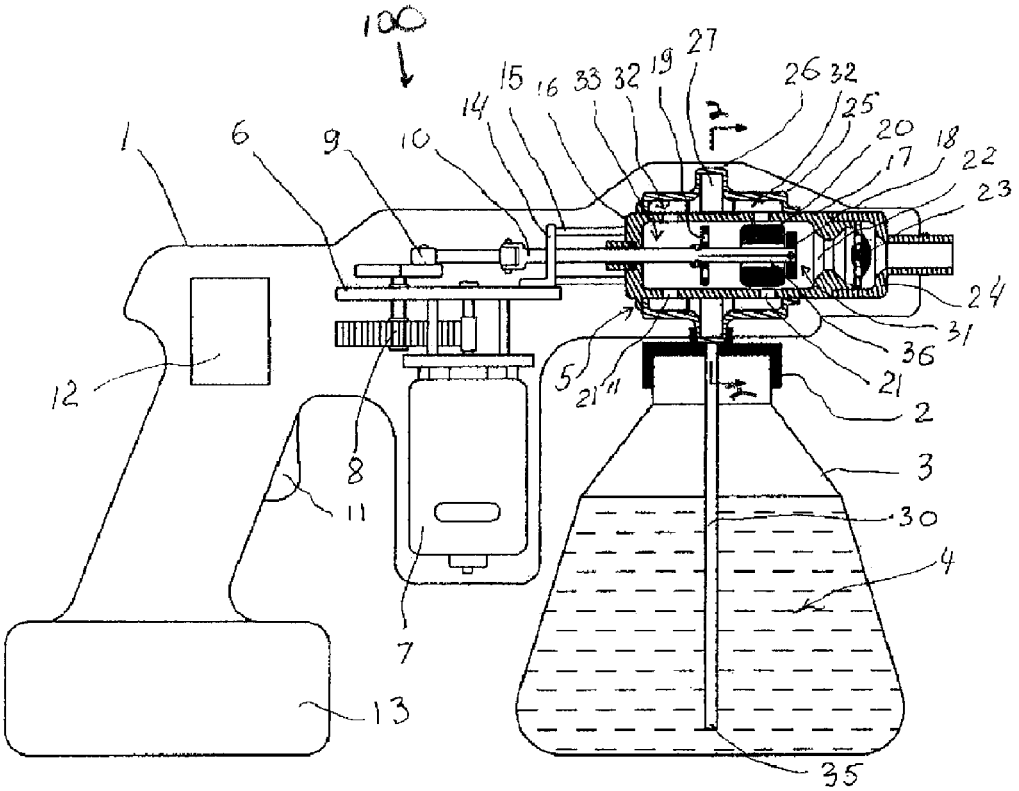
FIG. 1 is a cross-sectional view of a vibratory cavitation pump constructed according to the present disclosure.

With reference now to the drawing figures in which like reference numbers identify like parts throughout the disclosure, in FIG. 1 a first embodiment of the vibratory cavitation pump of the present disclosure is illustrated generally at 100. The pump 100 includes a case or housing 1 including a securing member 2, such as a threaded collar or clip, among others, that is used to fasten a container 3, such as a bottle, to the housing. The container 3 can hold virtually any type of fluid or liquid 4 to be pumped, as will be described.

The liquid 4 in the bottle 3 is in contact with a pump mechanism 5 disposed within the housing 1 that can effectively displace the fluid 4. In one embodiment shown in FIG. 1, a frame 6 is fixed to the housing 1 to support an electric motor 7 that is operably connected to a reducer 8 that is in turn connected to an oscillating member 9 that transforms the rotation of a shaft of the motor 7 in longitudinal movement of a rod 10 connected to the mechanism 9 opposite the reducer 8.

The motor 7 is operably connected to a suitable power source, such as a number of batteries 13 or via a cord and plug (not shown) connectable to a building power grid. The operation of the motor 7 can be controlled through the use of a switch 11, which is used to turn the motor 7 on and off, and a modulating device 12, which is utilized to control the speed of operation of the motor 7, and thus control the frequency of oscillation of the rod 10.

Also connected to the frame 6 is an arm 14 from which extend a pair of flanges 15 affixed to a securing member 16 disposed on a working cylinder 17 of the pumping mechanism 5. The working cylinder 17 is formed as a cylindrical member having a sealed aperture 102 at one end through which the rod 10 extends, and an outlet end 22. The cylinder 17 can also have a number of alternative configurations, such as a rectangular cross-sectional shape. The working cylinder 17 also includes a number of openings 21 extending through the cylinder 17 that are disposed between the aperture 102 and the outlet end 22.

Figure 2:
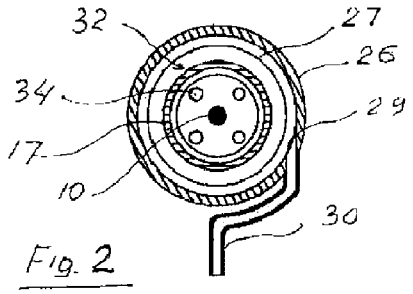
FIG. 2 is a cross-sectional view along line 2-2 of FIG. 1.

Within the working cylinder 17 and on the rod 10 are disposed a piston 18, a disk 19 and an activator 20. The piston 18 and disk 19 are secured to the rod 10 a specified distance from each other, while the activator 20 include a central passage 36 through which the rod 10 extends, such that the activator 20 is slidably mounted on the rod 10 between the piston 18 and the disk 19. In one embodiment, the piston 18 and disk 19 have generally circular shapes, with the disk 19 having a number of apertures 34 formed therein, as shown in FIG. 2. Further, in one embodiment the activator 20 can be formed to be cylindrical in shape, but may also be formed with other alternative shapes, such as a spherical shape.

The exhaust outlet 22 is defined by a narrowing of the working cylinder 17 and includes a valve 23 which restricts the flow of fluid through the outlet 22 and through a nozzle 24 disposed adjacent the valve 23 opposite the outlet 22.

In the embodiment shown in FIG. 1, on an external surface of the working cylinder 17 is disposed an external cylinder 25. The external cylinder 25 is formed similarly to the working cylinder 17 and is secured to the working cylinder 17 over the apertures 21. As shown in FIGS. 1 and 2, the external cylinder 25 includes an annular ring 26 that extends outwardly from the external cylinder 25, forming a ring cavity 27. An inlet pipe 30 is connected on a tangent to the ring 26 via an aperture 29, such that fluid 4 entering the ring 26 through the aperture 29 has a rotational motion imparted to it as it is directed around the ring 26. From the ring cavity 27, the fluid 4 drawn up from the container 3 through the pipe 30 is then directed into an internal cavity 32 of the external cylinder 25 prior to entering the working cylinder 17 through the apertures 21.

In operation, when the switch 11 is activated to direct electric current from the battery 13 through the modulator 12 to the motor 7, the motor 7 operates the mechanism 9. The mechanism 9 longitudinally moves rod 10 with the piston 18, a disk 19 and the activator 20 within the internal cavity 31/33 of the working cylinder 17. With the movement of the piston 18 and disk 19 out of the cylinder 17, the piston 18 moves towards and engages the activator 20, closing the channel 36 within the activator 20 and urging the activator 20 to move with the piston 18. This movement of the rod 10, piston 18 and activator 20 towards the left cavity portion 33 creates a zone of lowered pressure, i.e., vacuum, in the right cavity portion 31 of the working cylinder 17 that functions to draw the liquid 4 out of the container 3 through the pipe 30, as described one or more of U.S. Pat. Nos. 6,315,533; 6,364,622; 6,428,289; 6,604,920; 7,354,255B1; and 7,731,105B2, as well as in Published US Patent Application No. US2009/0116979, each of which is expressly incorporated by reference herein. As the fluid 4 reaches the pumping mechanism 5, it enters the ring cavity 27 and is accelerated in a circular path within the cavity 27, in order to fill the internal cavity 32 of the external cylinder 25. The accelerated liquid 4 subsequently is directed through the apertures 21 into the right cavity portion 31 defined within the working cylinder 17.

Subsequently, as the rod 10 begins to move in the opposite direction out of the left cavity portion 33 towards the right cavity portion 31 due to the oscillating movement of the mechanism 9, the disk 19 contacts the activator 20, closes the channel 36 in the activator 20 and together with the activator 20 urges the liquid 4 out of the right cavity portion 31 through the outlet 22. In passing through the outlet 22, the pressure of the fluid 4 is sufficient to open the valve 23 such that the fluid 4 can be discharged in a pressurized manner through the nozzle 24.

As the rod 10 moves towards the right cavity portion 31, the liquid 4 is drawn into the left cavity portion 33 of the working cylinder 17 in order to replacement the liquid 4 expelled from the right cavity portion 31 through the valve 23 and nozzle 24. This process of operation of the pump mechanism 9 is repeated at a frequency which is defined by speed of operation the motor 7.

Further, as a result of the oscillating movement of the rod 10 in the cylinder 17, the activator 20, the piston 18 and the disk 19 regularly and alternately collide with the lateral surfaces of the activator 20. In the course of these collisions, kinetic energy is created which affects the liquid 4 in the working cylinder 17 by promoting cavitation of the liquid 4 in the working cylinder 17, which results in actively mixing the liquid 4, consequently reducing forces of intermolecular coupling in the liquid 4, thereby reducing the viscosity of the liquid 4 and increasing the pumpability of the fluid 4.

In addition, in conjunction with the oscillatory movement of the rod 10, piston 18, disk 19 and activator 20, cavitation of the fluid 4 in the working cavity 17 is created by the shape of the ring cavity 27. As the fluid 4 is drawn into the ring cavity 27 via the pipe 30, the cavity 27 causes an accelerated rotary movement of the stream of fluid 4 in the cavity 27 around the working cylinder 17. As more fluid 4 is drawn into the ring cavity 27, the accelerated fluid 4 is displaced into the working cylinder 17 through the apertures 21 and distributed into the left and right portions 31 and 33 of the cavity 32 of the working cylinder 17. The entrance of the accelerated fluid 4 creates zones of active compression and variable pressure in the working cylinder 17, thus providing an alternative and steady source of cavitation of the fluid 4. This cavitation of the fluid 4 is accompanied by a sharp increase of pressure in the working cylinder 17 and as a consequence the fluid being pumped is altered in into a microdrop form, comparable in quality to fog, that provides the best molecular interaction potential.

The pump mechanism 9 can be operated over a wide frequency range to create the cavitation of the fluid 4 within the working cylinder 17, with a minimum oscillation frequency being about 1-5 Hz. This minimum operating mode of the pump mechanism 9 corresponds to the best conditions for pumping highly viscous liquids which produces an effective discharge fluid stream in absence cavitation.

Figure 3:
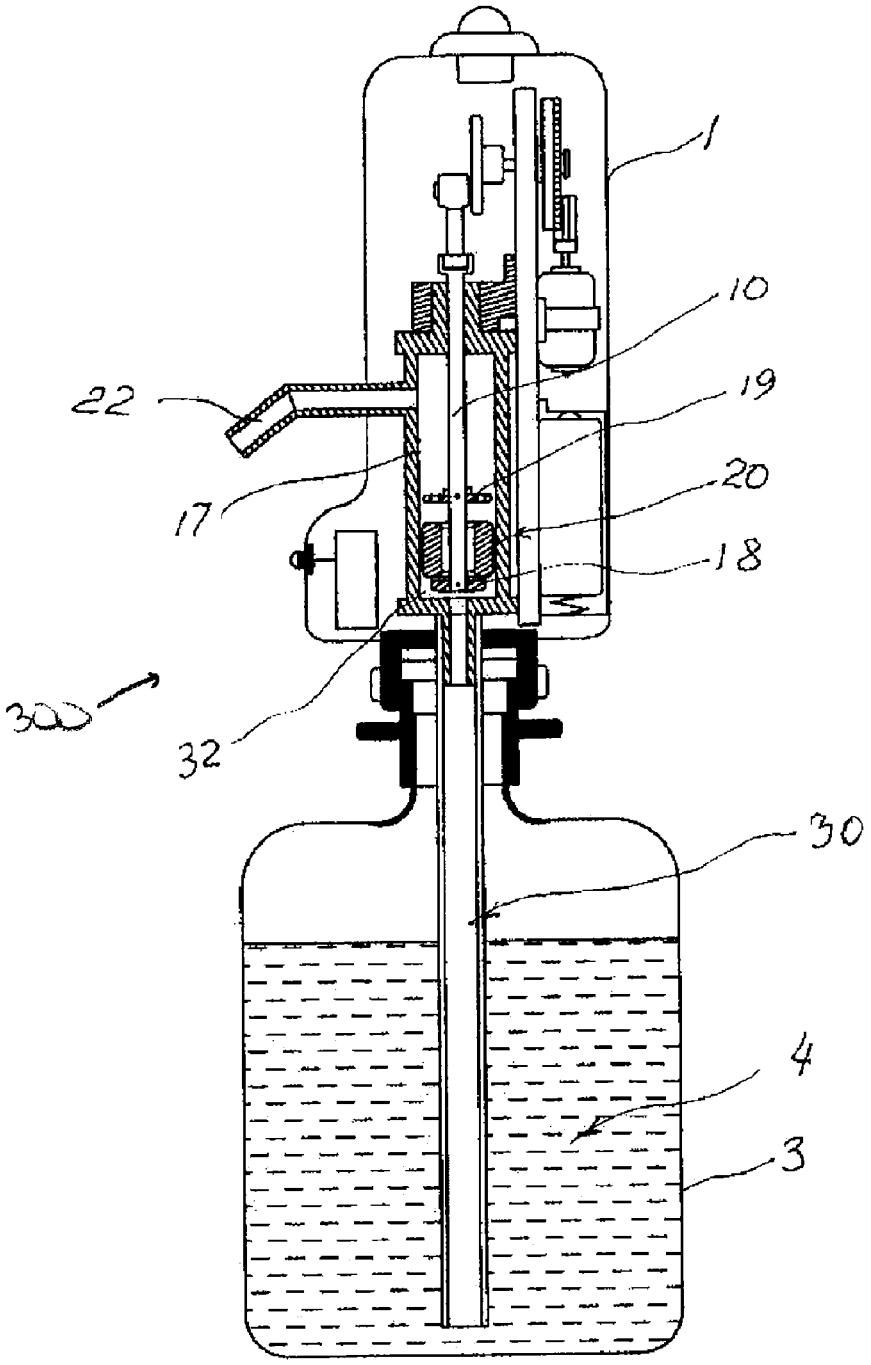
FIG. 3 is a cross-sectional view of a second embodiment of the vibratory cavitation pump of the resent disclosure.

Referring now to FIG. 3, a second embodiment of the vibratory cavitation pump 300 is illustrated. This pump 300 is developed for use with liquids of various viscosity, including liquid soap, lotions, a cream, lubricating oils and other dense lubricant products while considerably reducing the losses of electric energy during the operation of the pump 300.

The pump 300 is formed similarly to the pump 100, with the main differences being the orientation of the working cylinder 17 in a vertical direction on the frame 6, the removal of the external cylinder 25 and apertures 21 in the working cylinder 17, and the switching of the placement of the pipe 30 and outlet 22 relative to the working cylinder 17.

In operation, the movement of the rod in the working cylinder 17 draws the fluid 4 up the pipe 30 into the cavity 32, where it is acted upon by piston 18, disk 19 and activator 20 in the manner described previously, prior to the fluid being discharged through the outlet 22.

Figure 4:
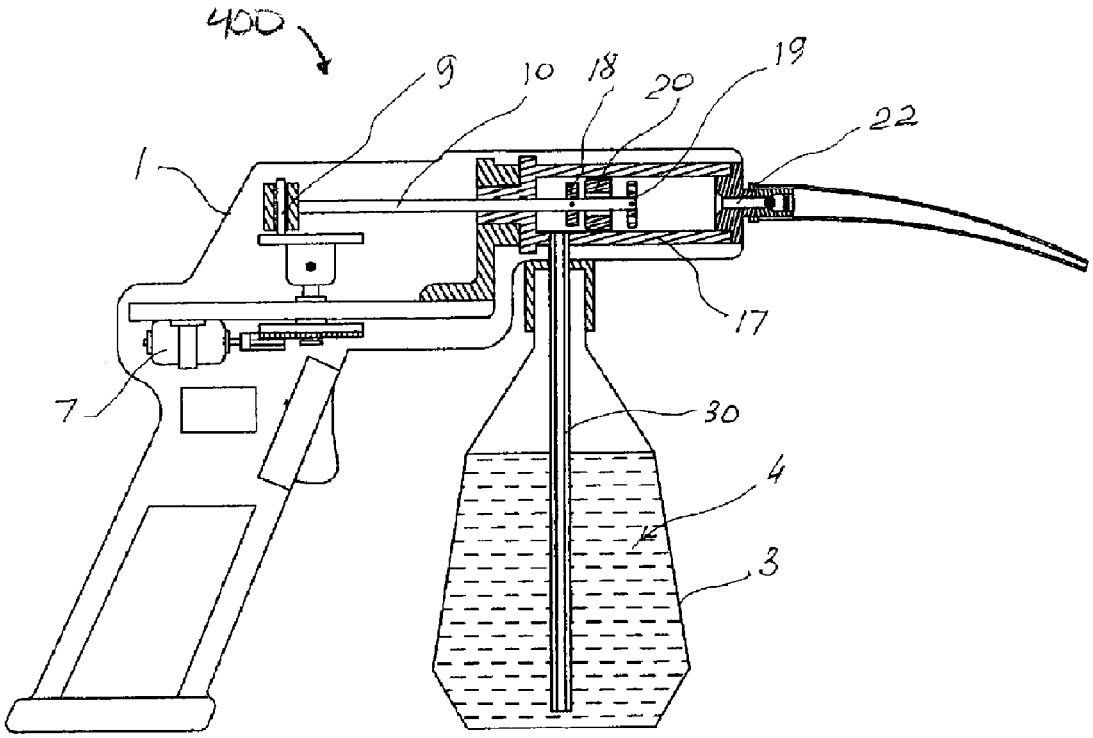
FIG. 4 is a cross-sectional view of a third embodiment of a vibratory cavitation pump constructed according to the present disclosure.

Looking now at FIG. 4, a third embodiment of the pump 400 is illustrated. In this embodiment, pump 400 is formed similarly to the pump 300, without the external cylinder 25 and apertures 21 in the working cylinder 17, but the cylinder 17 is again oriented horizontally with the inlet pipe 30 and outlet 22 reverting back to locations similar to the first embodiment for the pump 100. The pump mechanism 9 for the pump 400 is formed as a conventional reciprocating tool having a motor 7 disposed therein which is connected to the mechanism 9 in order to selectively oscillate the rod 10 and operate the pump 400 in a manner similar to that described previously regarding pump 100.

In addition to the above description, the following are some of the advantages of the pump of this present disclosure:

Technical and Economical Advantages of Pump

1. Simple and reliable production of vibratory-cavitation pumps and other devices.
2. Easy to manufacture them from various materials including plastics.
3. There are no valves, springs and other fast wearing parts.
4. In working reservoirs with a fluid pressure corresponds to the atmospheric.
5. Reduction up to 20-25% of energy consumption during elevation, transportation and spraying of liquids.
6. Safely pumping aggressive liquids (concentrated acids, alkali, and etc.) and taking probes of those.
7. Pumps can be produced with different productivities (or flow rates) from 3 ml/sec to 200 ml/sec and more; pressures from 10 PSI up to 350 PSI.
8. Electric motors can be used having power from 3 watt to 1 kilowatt and more; also various electro vibrators of different productivity can be used with alternating current or with converters.
9. In households the pumps for spraying liquids can be used with batteries of AA 1.5 V or rechargeable batteries of 7-18 V.

The Potential Use of the Vibratory Cavitation Pumps

1. Chemical industry and laboratories.
2. Transportation of viscous oils, liquid soap, lotions.
3. In scientific laboratories.
4. Micro- and mini pumps for cooling electronic chips.
5. Medicine: in metering devices, in devices for disinfection of premises, in devices for preparation of medical cocktails, in mechanisms for artificial blood circulation, in devices for flushing out of blood vessels and in other applications.
6. Perfumes development and production: In devices for manufacturing emulsion on the basis of essential oil and water with concentration of water to 60%, in devices for manufacturing of medical flints.
7. Agriculture: In devices for spraying plants, in devices for sanitary machining of plants and a premise of poultry plants, the cattle and equipment maintenance.
8. In devices for sanitary, chemical and radiation clearing and protection of people and buildings, cars and other civil and military objects.
9. In devices for more efficient combustion of fuels.
10. In devices for development and production of alternative aspects fuels.
11. Vibratory-cavitation technology can be efficiently used for creation and production of new materials of custom-made, new combination of properties, for handling and storage of nuclear wastes.

Numerous alternative embodiments of the present disclosure are contemplated as being within the scope of the following claims which particularly point out and distinctly claims the subject matter regarded as the present invention.

We claim:

1. A vibratory cavitation pump comprising:

a. a working cylinder having an fluid inlet and a fluid outlet;
b. a rod extending into the cylinder;
c. a piston fixed to the rod;
d. a plate fixed to the rod and spaced from the piston and spaced inwardly along the rod from an outer end of the rod;
e. an activator slidably mounted to the rod between the piston and the plate, the activator including a central passage through which the rod extends, the central passage defining a space between an exterior surface of the rod and the activator; and
f. an oscillating pumping mechanism operably connected to the rod opposite the end of the rod to move the rod with respect to the working cylinder wherein the plate includes a number of apertures therein.

2. The pump of claim 1 wherein the fluid outlet includes a valve.

3. The pump of claim 1 further comprising an external cylinder disposed around and in fluid communication with the working cylinder.

4. The pump of claim 3 wherein the fluid inlet includes a number of apertures formed in the working cylinder to enable fluid in the external cylinder to flow into the working cylinder.

5. The pump of claim 3 wherein the external cylinder comprises;

a. an internal cavity; and b. a ring extending radially outwardly from the external cylinder and defining an annular ring cavity therein.

6. The pump of claim 5 wherein an inlet pipe is tangentially connected to the ring.

7. A method of pumping a fluid, the method comprising the steps of:

a. providing a pump according to claim 1;

b, placing the fluid inlet in communication with a fluid reservoir; and c. activating the pumping mechanism.

* * * * *